US006078294A

United States Patent [19]

Mitarai

[11] Patent Number: 6,078,294

[45] Date of Patent: Jun. 20, 2000

[54] ANTENNA DEVICE FOR VEHICLES

[75] Inventor: Koichi Mitarai, Toyota, Japan

[73] Assignee: Toyota Jidosha Kabushiki Kaisha, Toyota, Japan

[21] Appl. No.: 09/141,262

[22] Filed: Aug. 27, 1998

Related U.S. Application Data

[63] Continuation of application No. PCT/JP97/00505, Feb. 24, 1997.

[30] Foreign Application Priority Data

Mar. 1, 1996 [JP] Japan ..... 8-045086

[51] Int. Cl.[7] ..... H01Q 1/32

[52] U.S. Cl. ..... 343/713; 343/711; 343/700 MS

[58] Field of Search ..... 343/713, 711, 343/712, 700 MS, 714; 455/345; H01Q 1/32

[56] References Cited

U.S. PATENT DOCUMENTS

| | | | |
|---|---|---|---|
| 4,760,394 | 7/1988 | Takeuchi et al. | 340/825.54 |
| 5,649,316 | 7/1997 | Prudhomme et al. | 455/345 |

FOREIGN PATENT DOCUMENTS

| | | |
|---|---|---|
| 60-158702 | 8/1985 | Japan . |
| 61-107206 | 7/1986 | Japan . |
| 62-39903 | 2/1987 | Japan . |
| 62-39905 | 2/1987 | Japan . |
| 63-40013 | 3/1988 | Japan . |
| 63-250903 | 10/1988 | Japan . |
| 63-170349 | 11/1988 | Japan . |
| 2-85656 | 7/1990 | Japan . |
| 3-19743 | 2/1991 | Japan . |
| 3-28041 | 3/1991 | Japan . |
| 5-175721 | 7/1993 | Japan . |
| 6-169217 | 6/1994 | Japan . |
| 6-169219 | 6/1994 | Japan . |
| 7-1619 | 1/1995 | Japan . |

*Primary Examiner*—Hoanganh Le
*Attorney, Agent, or Firm*—Burns, Doane, Swecker & Mathis, LLP

[57] ABSTRACT

A TV antenna assembly is constituted by a first belt-like antenna element and a second linear antenna element, and is stuck in a loop onto the inner surface of a door mirror case. Improved characteristics are obtained owing to a combination of the capacitance feature of the first antenna element and the inductance feature of the second antenna element. The wiring is easily routed since the antenna assembly is connected to the side of the car body through the second antenna element. The GPS antenna assembly is arranged on the rear side of the mirror.

9 Claims, 8 Drawing Sheets

ANTENNA DEVICE FOR VEHICLES

This application is a continuation of International Application No. PCT/JP97/00505 filed on Feb. 24, 1997 and claims priority under 35 U.S. C. § 120 of International Application No. PCT/JP97/00505.

BACKGROUND OF THE INVENTION

1. Field of the Invention

The present invention relates to such an antenna device for vehicles that can be made available by installing an antenna assembly in a door mirror case of a vehicle.

2. Description of the Related Art

Radio and TV tuners have so far been mounted on vehicles. In addition, an increasing number of mobile telephone and/or data processing terminals and global positioning systems (GPSs) applied to car navigation systems have been mounted on vehicles.

Receiving radio waves is essential to the use of such equipments on vehicles and necessitates antenna provision. Because the wider the field of view of an antenna, more easily the performance of the antenna will be assured, it is ideal that an antenna protrudes from the car body after installed from only the point of view of antenna performance. However, the antenna protruding from the car body has also demerits, such as causing a bottleneck in car design and wind noise during drives. That is why car designers and users prefer antennas that do not protrude from the car body if possible to those protruding.

As one type of antennas that do not protrude from the car body, glass antennas have been used to provide an antenna pattern arranged on the surface of the rear window glass. One problem of glass antennas is that they are liable to be affected by the variation in specific inductive capacity of the window glass and thus managing the production process is difficult. Another problem has been proposed that arranging many lines of an antenna pattern in an area on the glass limits the field of view of the driver.

Another possible location where such antennas can be provided is the inside of on the rearview mirror assembly or the outside mirror (door mirror) assembly. Installing such antennas in these locations completely eliminates the problem of external appearance. Japanese Patent Laid-Open Publication No. Sho 63-170349 proposed the antenna provision arranged on the inside of the rearview mirror assembly and the outside mirror assembly.

If an antenna is arranged on the inside of the door mirror assembly, its size must be small. In order to reduce the size of an antenna for receiving TV broadcasting carriers, which is referred to as a TV antenna hereinafter, it is suitable to make it a belt shape rather than a linear shape. However, the door mirror can be turned to the close position and it is generally thought that a belt-shaped antenna is hard to retain its shape when in the close position.

As regards an antenna for receiving GPS carriers, which is referred to as a GPS antenna hereinafter, it is relatively easy to reduce the size of the antenna assembly. Thus, it is thought that a GPS antenna can be housed in the door mirror assembly in the physical (dimensional) aspect. However, if the size of a GPS antenna assembly is reduced, its antenna receiving performance may often be likely to degrade significantly and the decrease in the production yield is anticipated. That is why no proposal has so far been made to house a GPS antenna in the door mirror assembly. In addition, such GPS antennas have to be protected from the adverse effect caused by radio waves reflected by roads.

SUMMARY OF THE INVENTION

The present invention has been devised through the consideration of the technical challenges noted above. An object of the invention is to provide a suitable antenna device to be installed in a vehicle's door mirror assembly.

An antenna assembly according to one aspect of the invention is so arranged as to nearly surround the periphery of the mirror in a door mirror case. Thus, a sufficient length of the antenna assembly is provided to receive TV broadcasting carriers. The antenna assembly includes a first belt-like antenna element and a second linear antenna element connected in series to the first antenna element. Besides, the back surface of the belt of the first antenna element is secured to the rim of the inside of the door mirror case and the second antenna element is arranged on the rim of the door mirror case inward end that is attached to the vehicle.

TV broadcasting carriers are received by the first antenna element which is belt shaped and suitable for receiving a wide range of TV carrier bands of radio waves. If the first antenna element is shortened to tune with the center frequencies of the receivable radio waves, it becomes rather capacitive and the second antenna element becomes rather inductive. An ideal antenna can be obtained by making the reactances of both cancel each other. Furthermore, the mirror acts as another antenna element requiring no power application and can perform effective broad-band reception.

The second antenna element is located on the inward end of the door mirror case at which the door mirror case is attached to the vehicle, so that it can easily keep the connection to the vehicle, reducing the possibility of being hindered by the operation of a door mirror turning and closing mechanism.

According to another aspect of the invention, a GPS antenna is used as an antenna assembly to be installed in a vehicle's door mirror case and the GPS antenna assembly is located at the rear of the mirror body so as to be oriented upward.

Because the door mirror assembly protrudes from the vehicle outer surface, it provides a relatively wide field of view to catch a satellite for GPS and radio waves from the satellite can be received by the antenna installed in it effectively.

Because the GPS antenna is located at the rear of the mirror, the inclusion of radio waves reflected by buildings and roads and the errors induced by it can be reduced and thus accurate positioning of the vehicle can be performed.

Furthermore, the another aspect of the invention assumes the provision of a motor-operated actuator to change the angle of the mirror body. The GPS antenna is positioned behind the vehicle front side of the mirror body and inward in the direction toward the vehicle center from the location of the motor-operated actuator or above the motor-operated actuator. In this antenna position, the actuator can also prevent the reception of the reflected radio waves.

The size of the GPS antenna can be reduced by using a microstrip antenna as the antenna element that forms the GPS antenna. By providing two power feed points, the axial ratio can be improved significantly.

DETAILED DESCRIPTION OF THE PREFERRED EMBODIMENTS

How the present invention is embodied in optimal two modes will be described with reference to the drawings.

[First mode]

Figure 1:
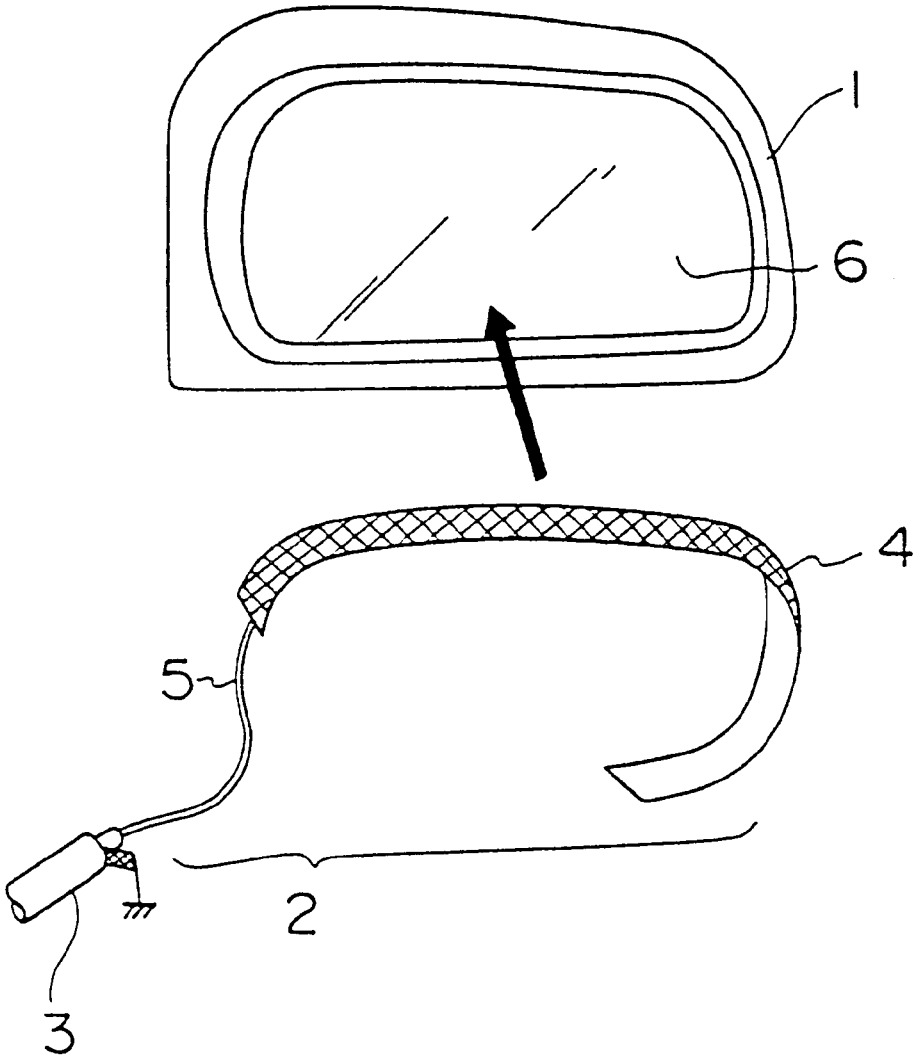
FIG. 1 is a view showing the structure of an antenna assembly (TV antenna) in the first mode of implementing the invention.

FIG. 1 shows the structure of an antenna assembly for vehicles with regard to the first mode of implementing the invention. The antenna assembly (TV antenna assembly) 2 is installed on the rim of the inside of the door mirror case 1. The TV antenna assembly 2 is connected to a coaxial cable 3 for power supply and receives TV broadcasting carriers, while supplied with power through this cable.

The TV antenna assembly 2 consists of a first belt-like antenna element 4 and a second antenna element 5 which is a linear conductor. One end of the second antenna element 5 is connected to the core conductor of the coaxial cable 3 and its other end is connected to one end of the first antenna element 4. The other end of the first antenna element 4 is open. The outer conductor of the coaxial cable 3 is grounded to the car body. For example, it maybe connected to any point near a pillar on which the door mirror assembly is installed and only the core conductor extended into the door mirror case 1. Alternatively, the coaxial cable 3 may be extended into the door mirror case 1 and its outer conductor grounded to the car body through the metal pivot on which the door mirror case 1 is supported to be opened from and closed to the car body freely. The mirror 6 is installed on the inner surface of the door mirror case 1.

The first antenna element 4 is made of a band shaped conductor, such as conductive tape of copper foils, 20 to 30 mm wide and 200 to 300 mm long. The second antenna element 5 is a copper wire with a diameter of approx. 1 mm and a length of approx. 50 mm. These antenna elements 4 and 5 are stuck to the rim of the inside of the door mirror case 1. The first antenna element 4 is located on the upper and right (far end from the car body) sections of the rim of the door mirror case 1. The second antenna element 5 is located on the left (near end to the car body) section of the rim of the door mirror case 1. The door mirror case 1 is made of plastic material.

TV broadcasting carriers are received by this TV antenna assembly 2. First, the carriers are received by the first antenna element 4. Because this element 4 is band shaped and has many current passages, it can receive broad band radio waves necessary to the satisfactory reception of TV broadcast carriers.

The first antenna element 4 is shorter than a length required for receiving TV band radio waves. Thus, the impedance of this element 4 shows a rather capacitive characteristic. On the other hand, the impedance of the linear second antenna element 5, which is connected to the first antenna element 4, shows a rather inductive characteristic because of its linearity.

In this way, the TV antenna assembly 2 according to the first mode of implementing the invention is fabricated by connecting the capacitive first antenna element 4 and the inductive second antenna element 5. Thus, by adjusting the capacitive characteristics and inductive reactances of both, a total impedance results from that the reactances of both cancel each other. Consequently, the impedance can fulfill matching conditions and satisfactory receiving power can be applied to a TV receiver connected to the other end of the coaxial cable.

A loop is formed by the TV antenna assembly 2 so as to surround the mirror 6. Moreover, the reflective surface of the mirror 6 is fabricated of a conductive film (for example, an aluminum film deposited by vacuum evaporation). Thus, it can be seen that another conductive element requiring no power application is loaded on the TV antenna assembly 2. Using this mirror, the TV antenna assembly 2 can acquire a wider frequency band range. Consequently, strict requirement for the accuracy of the TV antenna assembly 2 is postulated, whereas the production yield will increase and cost reduction will be achieved.

The second antenna element is linear so that wiring the cable (wire harness) from the inside of the door mirror case 1 to the vehicle inside will be easy. It is beneficial that the assembly work of such antenna is simplified.

In the arrangement of the antenna assembly described above, the second antenna element 5 is assumed to extend outside the door mirror case 1. Meanwhile, an alternative arrangement is possible: the coaxial cable 3 may be guided into the door mirror case 1 and the outer conductor of the cable 3 grounded to the metal section (having the electrical continuity to the car body) provided on the pivot for turning the door mirror case 1. Additionally, the second antenna element is permitted to zigzag.

[Second mode]

Figure 2:
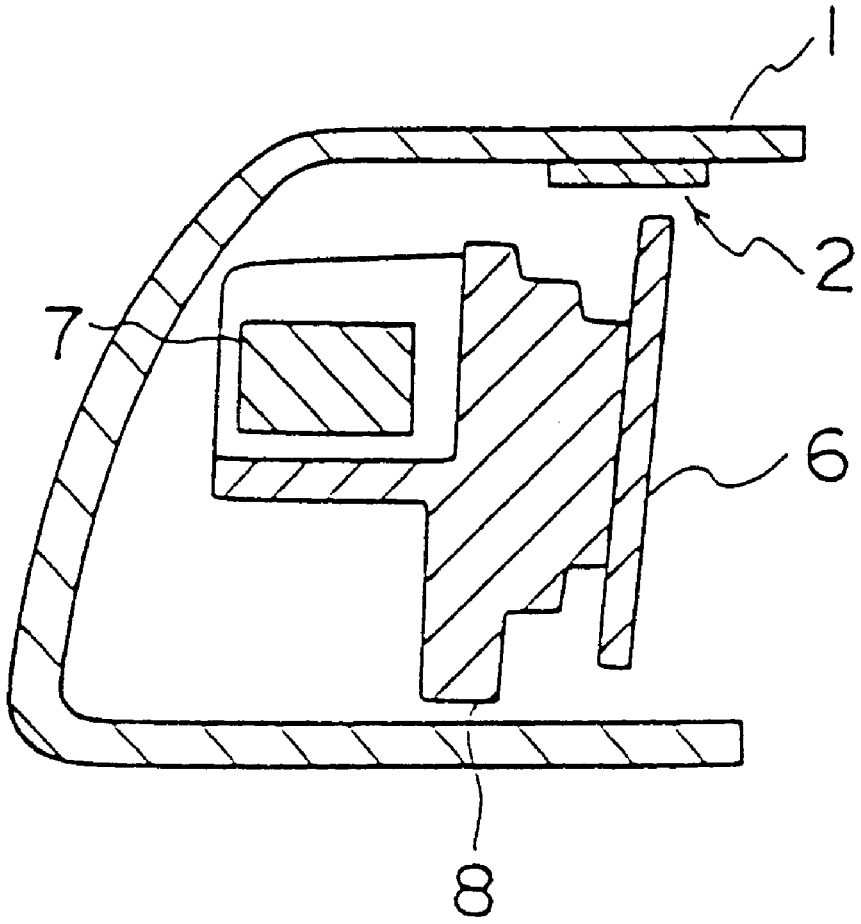
FIG. 2 is a view showing the cross sectional structure of a door mirror assembly including another antenna assembly (GPS antenna) in the second mode of implementing the invention.
Figure 3:
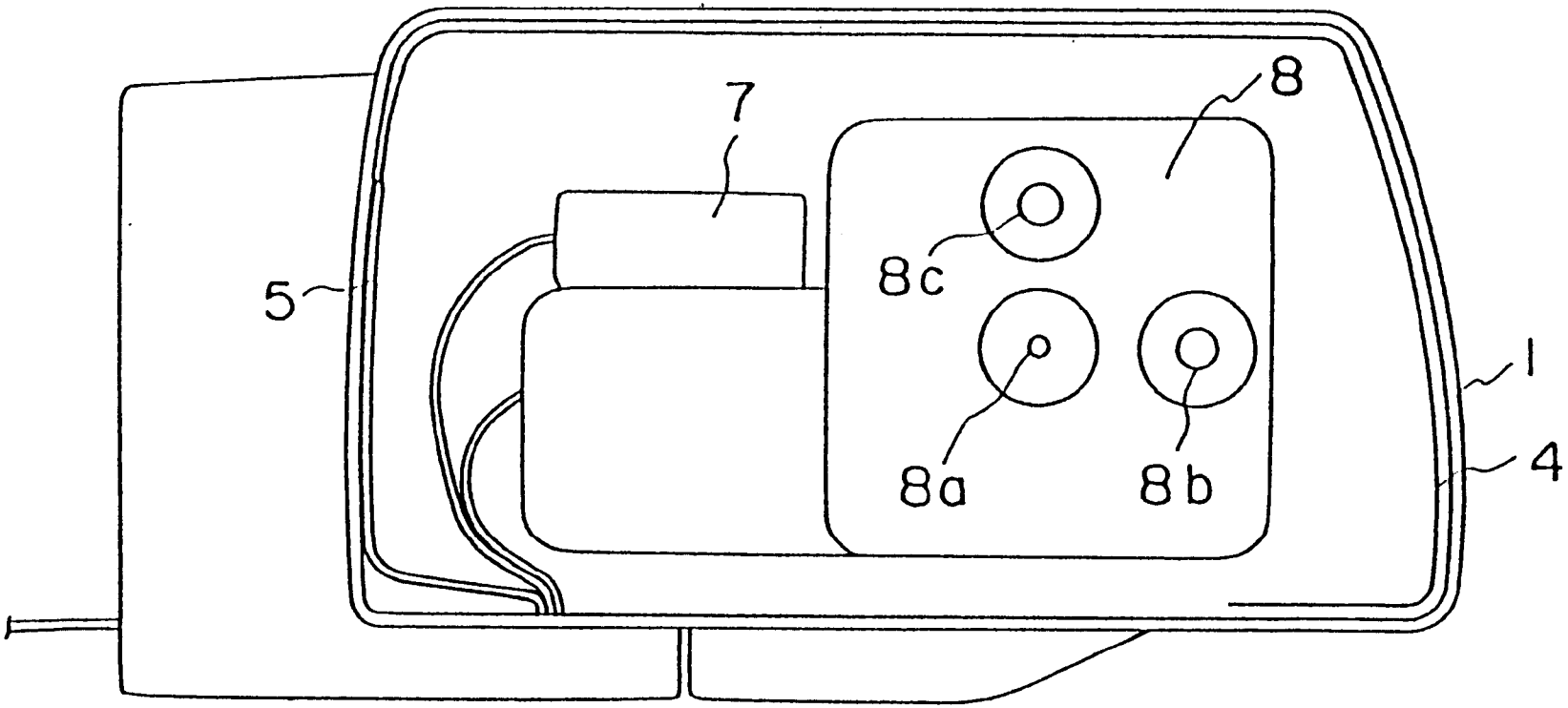
FIG. 3 is a front view of the same assembly in the second mode except that the mirror is removed.

FIG. 2 shows another antenna assembly for vehicles with regard to the second mode of implementing the invention. While the above-mentioned first mode concerns the TV antenna assembly 2, the second mode applies to a GPS antenna assembly 7. As shown in FIG. 2, a mirror 6 is installed on the vehicle front end of the inside of the door mirror case 1 and the GPS antenna assembly 7 is located at the rear of the mirror body. The mirror 6 is borne by a motor-operated actuator 8 for the mirror and the orientation of the mirror 6 is changed by the actuator 8 before and after/right and back. As shown in FIG. 3, the mirror 6 under static condition is supported by the motor-operated actuator 8 (support body) on one reference point 8*a* on its back, though it can pivot on this point. On one side of the reference point 8*a*, a right and left drive shaft 8*b* is installed which will advance and retract freely. Above (or below) the reference point 8*a*, a before and front drive shaft 8*c* is installed which will advance and retract freely. When the right and left drive shaft 8*b* advances or retracts, the mirror 6 turns on the horizontal level. When the before and front drive shaft 8*c* advances or retracts, the mirror 6 turns in the direction of elevation angles.

Figure 4:
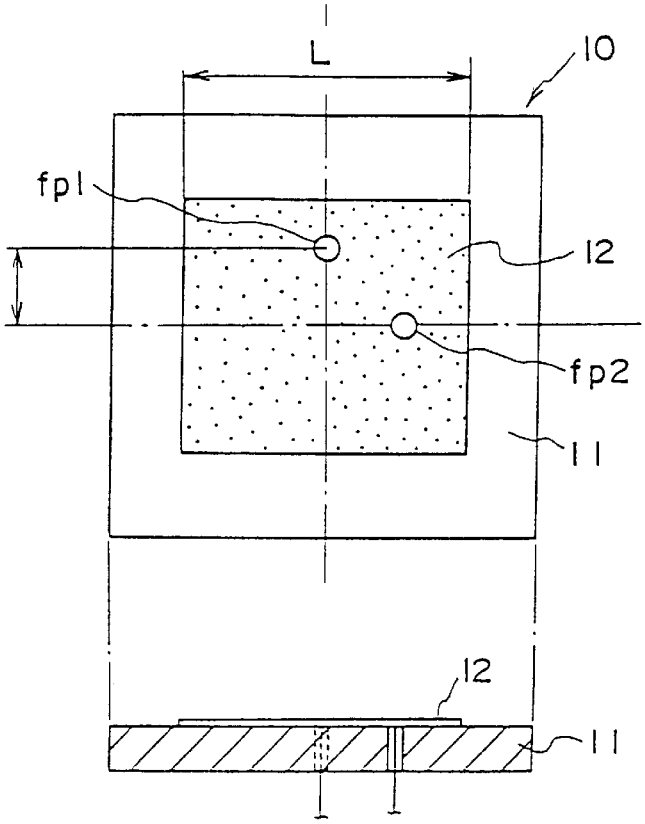
FIG. 4 is a view showing the structure of the antenna element in the second mode.

The GPS antenna assembly 7 is located at the rear of the inward side (nearer to the car body) of the motor-operated actuator 8. FIG. 4 is a view showing the structure of an antenna element 10 housed in the GPS antenna assembly 7. As shown, the antenna element 10 is a mircorstrip antenna of a square dielectric board 11, on the surface of which a smaller square antenna patch 12 of a thin film is laid. In this example, a ceramic board with each edge of 25 mm, a thickness of 4 mm, and a dielectric constant (permittivity) of approx. 21 is used as the dielectric board 11. A desirable range of dielectric constants is between 20 and 40. As the antenna patch 12, a baked copper printed film with each edge (L) of 20 mm is used.

In this mode of implementing the invention, two power feed points are provided on the antenna patch 12. As shown in FIG. 4, the antenna patch 12 has two feed points fp1 and fp2, each of which is positioned at a given distance from the center on each of the orthogonal axes through its center. These feed points assure that the antenna element is well excited by circular polarization.

If only a single feed point is employed, notches or protrusion must be provided on the edges of the antenna patch 12 to accomplish the excitation by circular polarization. As a result, the axial ratio of circular polarization varies greatly depending on the frequency.

Whereas, when two feed points are employed as in this implementing mode, a suitable axial ratio can be assured in a wide band since the antenna is excited by circular polarization according to the phase difference of the currents applied to the two points. Moreover, desired characteristics can be obtained by adjusting the distance of fp1 and fp2 from the center and the size (L×L) of the antenna patch 12.

Figure 5:
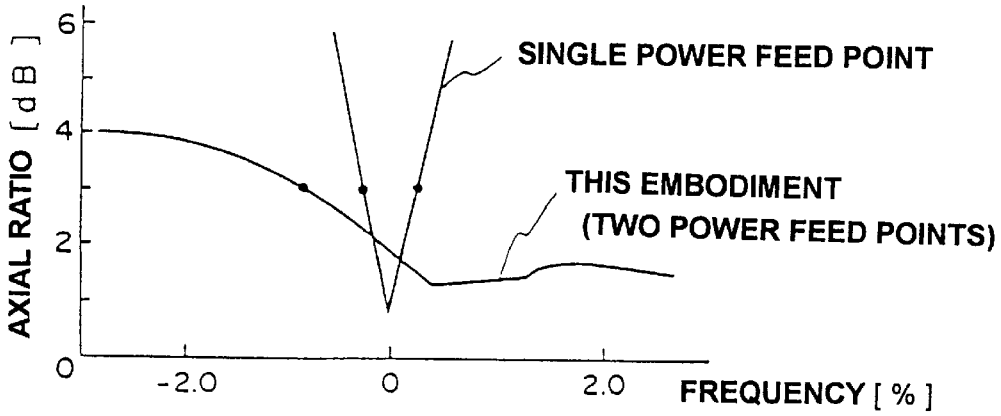
FIG. 5 is a graph for describing the axial ratio characteristics of the antenna element in the second mode.

FIG. 5 shows the relationship between axial ratio and frequency for one point and two points of power feed. As seen from this graph, in the case of one power feed point, a very good axial ratio is given at the center frequency, but the axial ratio becomes bad extremely as the frequency goes off the center frequency. In the case of two power feed points, a good and stable axial ratio is obtained in a wide range, showing that antenna excitation by suitable circular polarization is achieved in a wide range.

Such a microstrip antenna as used in this implementing mode enables a low (good) axial ratio in the entire (resonant) band received by the antenna (in a frequency range that standing-wave ratio (SWR) is 2 or less). Thus, the full antenna performance can be available.

On the other hand, in the case of the one-point power feed method, the antenna resonance band is not more than 20 to 30% of its full performance range.

Figure 6:
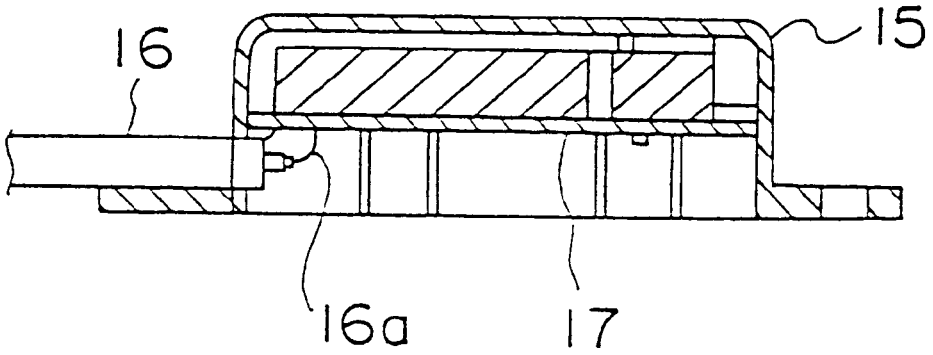
FIG. 6 is a view showing the structure of the GPS antenna assembly in the second mode.

The overall structure of the GPS antenna assembly 7 is shown in FIG. 6. As shown, the antenna element 10 is housed in a case 15. The core conductor 16*a* of a coaxial cable 16 is run through the dielectric board 11 and connected to the antenna patch 12 on the surface of the board.

Figure 7:
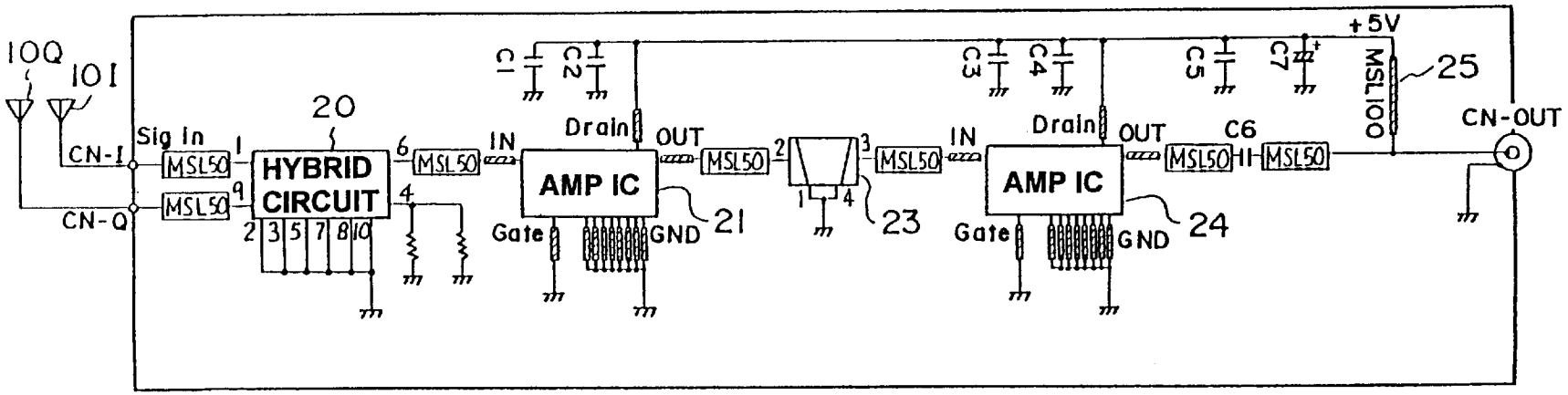
FIG. 7 is a circuit diagram showing the structure of a preamplifier circuit used in the second mode.

The antenna element 10 is mounted on a printed circuit board 17. On the back side of the printed circuit board 17, a preamplifier circuit including amp ICs and other components is arranged. FIG. 7 shows the preamplifier circuit diagram. In this diagram, the antenna element 10 to which power is fed at two points having 90 degrees phase difference with each other is represented as two antennas 10Q and 10I for convenience. These antennas 10Q and 10I are connected to a hybrid circuit 20 via connectors CN-I and CN-Q. This hybrid circuit 20 distributes feed currents to the antennas 10Q and 10I with the phases of the currents to the 10Q and 10I being different with each other by 90 degrees.

The hybrid circuit 20 is connected to an amp IC21. The amp IC21 performs the first stage amplification of received signals. The amp IC21 is connected to an amp IC24 via a band-pass filter 23. The amp IC24 amplifies the signals in a specific range of frequencies selected through the band-pass filter 23.

The output from the amp IC24 is connected to the core conductor 16*a* of the coaxial cable 16 through a capacitor C6. The outer conductor 16B of the coaxial cable 16 is connected to the ground on the printed circuit board. An approx. 5 V direct current (DC) is superimposed on the current carried through the core conductor 16*a* of the coaxial cable 16. The DC is extracted through a relatively narrow microstrip line 25 with a length being one fourth of the wave length of the center frequency and characteristic impedance being approx. 100 Ω and supplied to the amps IC21 and IC24 as the power source. Capacitors C1 through C5 and C7 are used to remove noise.

Excitation by circular polarization is produced by this preamplifier circuit and the current flowing to the antenna patch 12 is amplified and carried to the coaxial cable 16. The printed circuit board 17 is made of resin with a dielectric constant of approx. 10 and the wiring of the board 17 is arranged, using microstrip lines (marked MSL5O) with characteristic impedance of 50 Ω.

Figure 8:
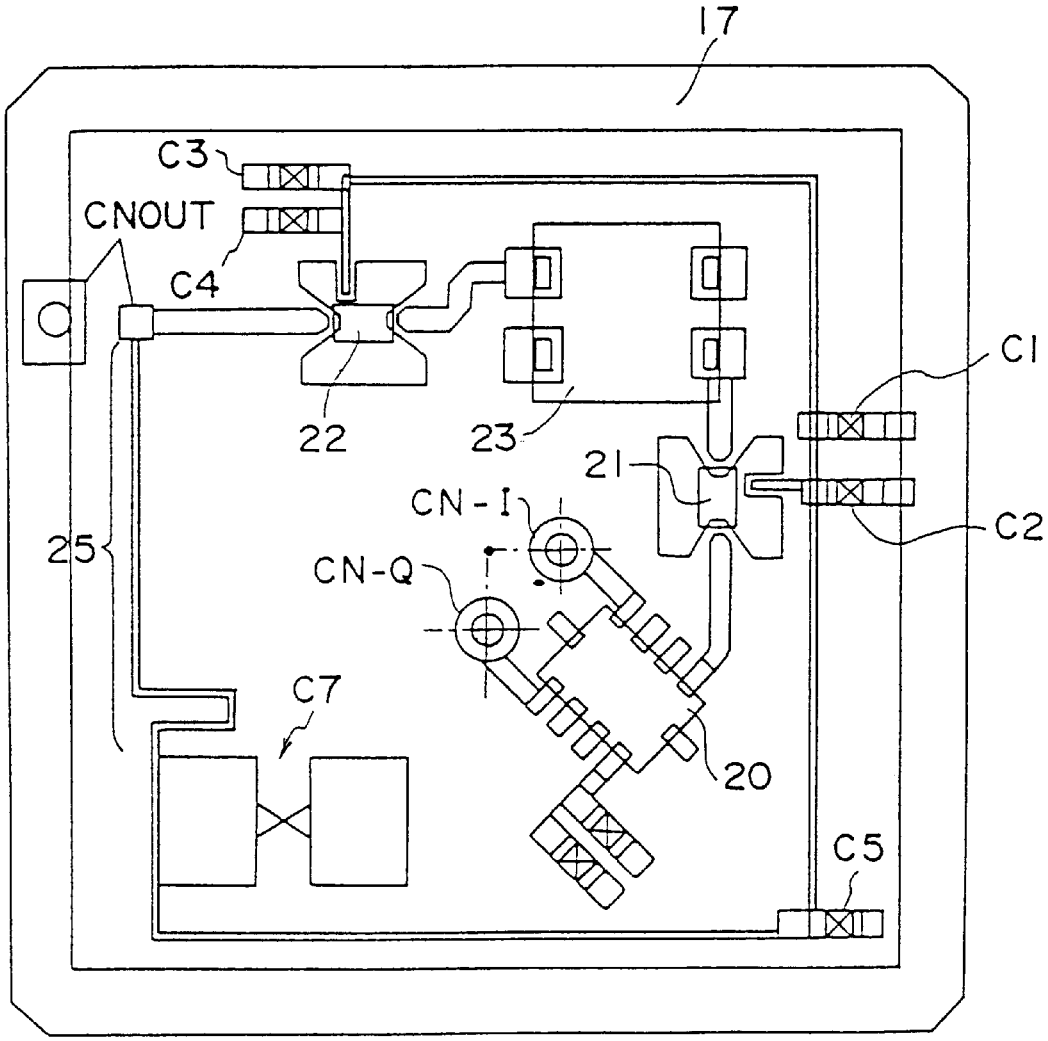
FIG. 8 is a view showing the arrangement of the components of the preamplifier circuit.

FIG. 8 is a view showing the arrangement of all components of the preamplifier circuit mounted on the printed circuit board 17. On one end (upper left) of the board, a connector CNOUT for making the connection to the equipment mounted on the vehicle is provided. The power line is routed down and the signal processing line is routed right before reaching the central. Signal input ends CN-I and CN-Q connected to the hybrid circuit 20 are positioned directly under the power feed points fp1 and fp2. This allows relatively short pins to make the connection with the antenna patch 12.

Figure 9:
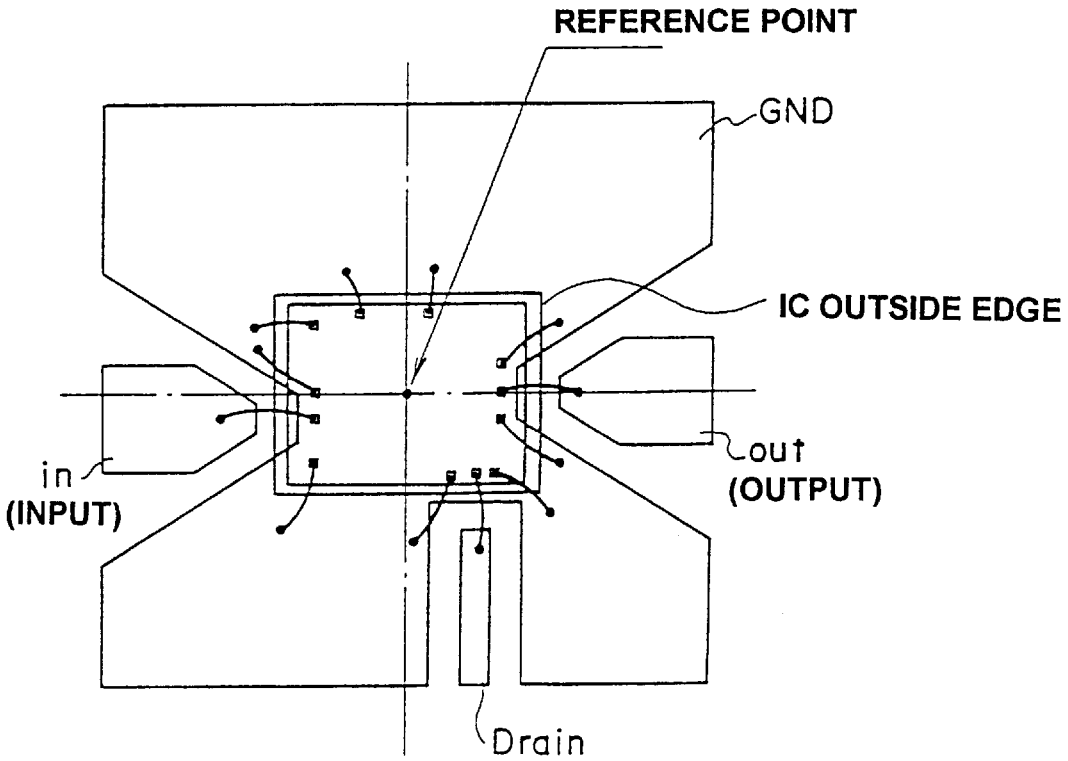
FIG. 9 is a view showing how wire bondings are arranged on each bare chip installed on the preamplifier circuit board.

It is desirable to fabricate the amps IC21 and IC24 of bare chips and make the connection between each amp and related microstrip lines by wire bonding. FIG. 9 shows how the wire bondings are arranged on each of the amps IC21 and IC24. In FIG. 9, bold lines, both ends of which are marked, represent wire bondings. The wire bondings can reduce the overall circuit size, assuring that the circuit provides adequate features.

By combining this preamplifier circuit board with the above described antenna element, a small and stable GPS assembly can be fabricated and the GPS assembly can be built in the door mirror case 1.

With the application of such GPS antenna, radio waves from a GPS satellite are received by the antenna patch 12 and the signals of these waves are supplied to the GPS receiver through the preamplifier and the coaxial cable 16. As described above, the GPS antenna assembly 7 is located at the rear of the mirror 6. This antenna location reduces the possibility that the antenna patch 12 receives the radio waves reflected by buildings and roads. Signal detection errors can be prevented accordingly and the GPS positioning accuracy will be improved. In addition, the motor-operated actuator for the mirror is located outside the GPS antenna assembly 7. The actuator also serves to block the reflected radio waves and can prevent signal detection errors due to the reflected waves.

Because the antenna element is mounted on the preamplifier circuit board 17 and the board is housed in the case, further work to make the antenna ready for operation is only connecting the other end of the coaxial cable to the GPS receiver. The antenna is adjusted to carry out the required capability when fabricated. Thus, no minor adjustment of the antenna element is required at installation and the assembly work is very simple.

Although the above focuses on an instance that the antenna element is used for GPS carrier reception only, the antenna of the same structure can be used to receive other radio waves, e.g., receiving radio waves from a beacon on roads to acquire traffic information or toll road charging information.

Furthermore, diversity reception can easily be achieved by installing such antennas in two door mirror cases.

No problem in external appearance arises on account of installing both TV and GPS antenna assemblies in one door mirror case.

Although the above scenario only applies to that the antenna assembly is installed in a door mirror case, a fender mirror case can replace the door mirror case provided it is the same shape as the door mirror case.

What is claimed is:

1. An antenna device for vehicles comprising:

an antenna assembly installed in a vehicle door mirror case, with a mirror installed in the door mirror case, said mirror possessing a periphery and said door mirror case having a rim, said antenna assembly being arranged on the rim inside the door mirror case in surrounding relation to the periphery of the mirror; and said antenna assembly including a first antenna element possessing a greater width than thickness and a second antenna element, said second antenna element being connected in series to the first antenna element.

2. The antenna device for vehicles according to claim 1, wherein said first antenna element possesses a back surface that is secured to the rim inside the door mirror case and said second antenna element is arranged on the rim of the door mirror case inward of an end of the door mirror case that is to be attached to the vehicle.

3. The antenna device for vehicles according to claim 2, wherein one end of a connecting cable that is connected to a receiver inside the vehicle is connected to said second antenna element.

4. The antenna device for vehicles according to claim 1, wherein the mirror includes a reflective surface that is electrically conductive.

5. The antenna device for vehicles according to claim 1, wherein said second antenna element has a cross-sectional shape that is different from a cross-sectional shape of the first antenna element.

6. An antenna device for vehicles comprising:

an antenna assembly installed in a door mirror case of a vehicle, with a mirror housed in the door mirror case, said mirror having a mirror surface, said antenna assembly including a GPS antenna for receiving global positioning system carriers, said GPS antenna being located rearwardly of the mirror in the door mirror case so as to be oriented upward;

a motor-operated actuator installed in the door mirror case and operatively associated with the mirror to change an angle of the mirror surface of said mirror; and said GPS antenna being positioned behind a vehicle front side of said mirror and inward in a direction toward a center of the vehicle from said motor-operated actuator so as to be hidden by said motor-operated actuator when viewed from outside.

7. The antenna device for vehicles according to claim 6, wherein said GPS antenna is a microstrip antenna including an antenna patch of a thin film and supplied with power at two points on the antenna patch.

8. An antenna device for vehicles comprising:

an antenna assembly installed in a door mirror case of a vehicle, with a mirror housed in said door mirror case, said mirror possessing a periphery, said antenna assembly including a GPS antenna for receiving global positioning system carriers, said GPS antenna being located rearwardly of the mirror so as to be oriented upward;

a motor-operated actuator installed in the door mirror case and operatively associated with the mirror to change an angle of the mirror surface of said mirror; and said GPS antenna being positioned behind a vehicle front side of said mirror above said motor-operated actuator so as to be hidden by said motor-operated actuator when viewed from a position below the mirror.

9. An antenna device for vehicles comprising:

at least two antenna assemblies installed in a vehicle door mirror case, with a mirror mounted in said door mirror case and supported on a support body, said mirror possessing a periphery and said door mirror case being provided with a rim, said at least two antenna assemblies including a first antenna assembly for receiving TV broadcasting carriers, said first antenna assembly being arranged on the rim inside the door mirror case in a manner substantially surrounding the periphery of the mirror, and a second antenna assembly for receiving global positioning system carriers, said second antenna assembly being located rearwardly of the mirror and the support body in the door mirror case so as to be oriented upward.

* * * * *